US005511381A

United States Patent [19]

Higginbotham

[11] Patent Number: 5,511,381

[45] Date of Patent: Apr. 30, 1996

[54] AIR SEPARATION

[75] Inventor: Paul Higginbotham, Guildford, United Kingdom

[73] Assignee: The BOC Group plc, Windlesham, England

[21] Appl. No.: 404,799

[22] Filed: Mar. 15, 1995

[30] Foreign Application Priority Data

Mar. 16, 1994 [GB] United Kingdom ..... 9405072

[51] Int. Cl.[6] ..... F25J 3/04

[52] U.S. Cl. ..... 62/646; 62/654; 62/924

[58] Field of Search ..... 62/25, 38

[56] References Cited

U.S. PATENT DOCUMENTS

| | | | |
|---|---|---|---|
| 5,237,822 | 8/1993 | Rathbone | 62/25 |
| 5,287,704 | 2/1994 | Rathbone | 62/38 |
| 5,355,682 | 10/1994 | Agrawal et al. | 62/38 |

FOREIGN PATENT DOCUMENTS

| | | |
|---|---|---|
| 0542539 | 5/1993 | European Pat. Off. . |
| 0580348 | 1/1994 | European Pat. Off. . |
| 2548222 | 1/1977 | Germany . |

*Primary Examiner*—Ronald C. Capossela
*Attorney, Agent, or Firm*—David M. Rosenblum; Larry R. Cassett

[57] ABSTRACT

An air separation method and apparatus in which a stream of air is compressed in a compressor and purified in a unit. One stream of the resulting air is cooled in a heat exchanger and is separated in an arrangement of rectification columns comprising a higher pressure rectification column, a lower pressure rectification column, and a further rectification column for separating argon from an argon-enriched oxygen stream withdrawn from the lower pressure rectification column and the stream of resulting air is introduced into the higher pressure rectification column through an inlet. A second cooled, compressed, purified air stream is expanded in an expansion turbine and is introduced into the lower pressure rectification column. A third cooled, compressed, purified air stream is expanded in a second expansion turbine and is introduced into the higher pressure rectification column. A fourth compressed, purified air stream is expanded in a third expansion turbine having an outlet temperature higher than those of the other two turbines and is further cooled in the heat exchanger and is introduced into the higher pressure rectification column. The arrangement of turbines enhances argon recovery when liquid nitrogen product is produced.

9 Claims, 2 Drawing Sheets

AIR SEPARATION

BACKGROUND OF THE INVENTION

This invention relates to a method and apparatus for separating air.

The most important method commercially for separating air is by rectification. In typical rectification processes, there are performed the steps of compressing a stream of air, purifying the resulting stream of compressed air by removing water vapour and carbon dioxide from it, and pre-cooling the stream of compressed air by heat exchange with returning product streams to a temperature suitable for its rectification. The rectification is performed in a so-called double rectification column comprising a higher pressure and a lower pressure rectification column, i.e. one of the two columns operates at a higher pressure than the other. Most of the incoming air is introduced into the higher pressure column and is separated into oxygen-enriched liquid air and a nitrogen vapour. The nitrogen vapour is condensed. A part of the condensate is used as liquid reflux in the higher pressure column. Oxygen-enriched liquid is withdrawn from the bottom of the higher pressure column and is used to form a feed stream to the lower pressure column. Typically, the oxygen-enriched liquid stream is sub-cooled and is introduced into an intermediate region of the lower pressure column through a throttling or pressure reduction valve. The oxygen-enriched liquid air is separated into substantially pure oxygen and nitrogen in the lower pressure column. Gaseous oxygen and nitrogen products are taken from the lower pressure column and typically form the returning streams against which the incoming air stream is heat exchanged. If desired, the gaseous oxygen product can be formed by employing air to vaporise a liquid oxygen stream withdrawn from the lower pressure column. Liquid reflux for the lower pressure column is provided by taking the remainder of the condensate from the higher pressure column, sub-cooling it and passing it into the top of the lower pressure column through a throttling or pressure reducing valve.

In the lower pressure rectification column there is created below the oxygen-enriched liquid air feed a local maximum concentration of argon. If it is desired to produce an argon product, an argon-enriched oxygen stream is withdrawn from below the level of the oxygen-enriched liquid air feed and is introduced into a further rectification column in which a crude argon product is separated from the argon-enriched oxygen, this crude argon product being taken from the top of the further column. Oxygen-enriched liquid is returned from the bottom of the further column to the lower pressure rectification column. If desired, one or both of a liquid oxygen and a liquid nitrogen product may be produced in addition to the gaseous oxygen and nitrogen product.

In order to meet the refrigeration requirements of the air separation process, a stream of incoming air or returning nitrogen is expanded in a turbine with the performance of external work. For example, a pan of the incoming air is taken out of heat exchange relationship with the returning nitrogen and oxygen streams and is expanded in a single expansion turbine to the pressure of the lower pressure column. The air so expanded is introduced into the lower pressure column. If more than about 5% of oxygen product of the lower pressure rectification column is collected in liquid state, it is typically desirable to employ a second expansion turbine which has an outlet temperature approximately equal to the inlet temperature of the first turbine. Use of such a second or 'warm' turbine enables there to be maintained a relatively close match between the enthalpy-temperature profile of the air being cooled and that of the streams being warmed, thereby making for efficient heat exchange between the incoming air and the returning oxygen and nitrogen streams. The proportion of the incoming air that flows through the first turbine depends on the proportion of the oxygen and nitrogen products that are collected in liquid state. The greater this latter proportion, the greater the proportion of the incoming air that flows through the first turbine. Increasing the proportion of air that is expanded in the first turbine, and hence fed to the lower pressure rectification column, beyond a certain optimum, reduces the amount of separation that is achieved in the lower pressure rectification column, and as a result reduces the amount of argon that is recovered. On the other hand, if the air is fed by the first turbine into the higher pressure rectification column, there is a greater requirement for compression work with the result that the power consumption for a given argon recovery is similarly increased. Accordingly, In the above-described air separation process it is not generally possible to produce efficiently argon at a yield of 80% or greater if a total of about 15 mole percent or more of the oxygen and nitrogen products are collected in liquid state.

It is an aim of the present invention to provide a method and apparatus for separating air which enables argon to be produced at a yield of about 80% if not less than 15% in total of the oxygen and nitrogen products are collected in liquid state.

SUMMARY OF THE INVENTION

According to the present invention there is provided a method of separating air, comprising the steps of cooling a first compressed air stream to a temperature suitable for its separation by rectification, separating nitrogen from the cooled first air stream in a higher pressure rectification column, employing directly or indirectly a stream of oxygen-enriched liquid air withdrawn from the higher pressure column as a feed stream to a lower pressure rectification column, withdrawing a liquid stream from an intermediate mass exchange region of the higher pressure rectification column and introducing the liquid stream into the lower pressure rectification column as a further feed stream, separating the said feed streams into nitrogen and oxygen in the lower pressure rectification column, withdrawing oxygen and nitrogen products from the lower pressure rectification column and employing them to cool incoming air for separation by indirect heat exchange therewith, collecting a liquid nitrogen product from the lower pressure rectification column, separating an argon product in a further rectification column from an argon-enriched oxygen stream withdrawn from the lower pressure rectification column, cooling a second compressed air stream, expanding the cooled second air stream in a first expansion turbine, introducing the resulting expanded second air stream into the lower pressure rectification column, cooling a third compressed air stream, expanding the cooled third air stream in a second expansion turbine, introducing the resulting expanded third air stream into the higher pressure rectification column, and expanding a compressed fourth air stream in a third expansion turbine which has an outlet temperature above that of each the first and second turbines, further cooling the resulting expanded fourth air stream and introducing the further cooled fourth air stream into one or both of the higher and lower pressure rectification columns.'

The invention also provides apparatus for separating air comprising a main heat exchanger for cooling a first compressed air stream to a temperature suitable for its separation by rectification; a higher pressure rectification column for separating nitrogen from the cooled first air stream; a lower pressure rectification column for separating into nitrogen and oxygen a feed stream formed directly or indirectly from oxygen-enriched liquid air withdrawn in use from the higher pressure column; means for the withdrawal of a liquid stream from an intermediate mass exchange region of the higher pressure column, said withdrawal means communicating with the lower pressure rectification column; means for withdrawing oxygen and nitrogen products from the lower pressure rectification column and for returning them through the main heat exchanger countercurrently to the incoming air; means for collecting a liquid nitrogen product from the lower pressure rectification column; a further rectification column for separating an argon product from an argon-enriched oxygen stream withdrawn in operation from the lower pressure rectification column; a first expansion turbine for expanding a cooled, second compressed air stream having an outlet communicating with the lower pressure rectification column; a second expansion turbine for expanding a cooled, third compressed air stream having an outlet communicating with the higher pressure rectification column; and a third expansion turbine for expanding a fourth air stream having an outlet communicating via air cooling means with one or both of the higher and lower pressure rectification columns.

Preferably, at least some of the oxygen product is withdrawn as a stream from the lower pressure rectification column in liquid state and is vaporised by countercurrent heat exchange with air being cooled. By employing a pump to raise the pressure of the liquid oxygen, an elevated pressure oxygen product stream may be produced at above the operating pressure of the higher pressure column. In such examples of the method and apparatus according to the invention, in order to maintain a relatively close match between the temperature-enthalpy profile of the nitrogen and oxygen product streams being warmed by heat exchange with that of the air streams being cooled in the same heat exchange, a fifth compressed air stream is preferably heat exchanged with the oxygen stream being warmed, is reduced in pressure by passage through a throttling valve and is introduced in liquid state into one or both of the higher and lower pressure rectification columns.

Preferably, the first turbine has an inlet pressure lower than the second turbine which in turn has an inlet pressure lower than the third turbine. Conveniently, the fifth air stream is introduced into heat exchange relationship with the oxygen product stream at the same pressure as the fourth air stream is introduced into the third turbine.

Preferably, all of the fourth air stream is introduced into the higher pressure rectification column.

If desired, part of the oxygen product may be collected in liquid state. Typically, reflux for the higher pressure and lower pressure rectification columns is formed by condensing the nitrogen product of the higher pressure rectification column by indirect heat exchange with boiling liquid oxygen in the lower pressure rectification column. Typically, reflux for the further column is formed by condensing argon at the top of the column by heat exchange with a part of the oxygen enriched liquid air.

BRIEF DESCRIPTION OF THE DRAWINGS

The method and apparatus according to the invention will now be described by way of example with reference to the accompanying drawings, in which.

DETAILED DESCRIPTION

Figure 1:
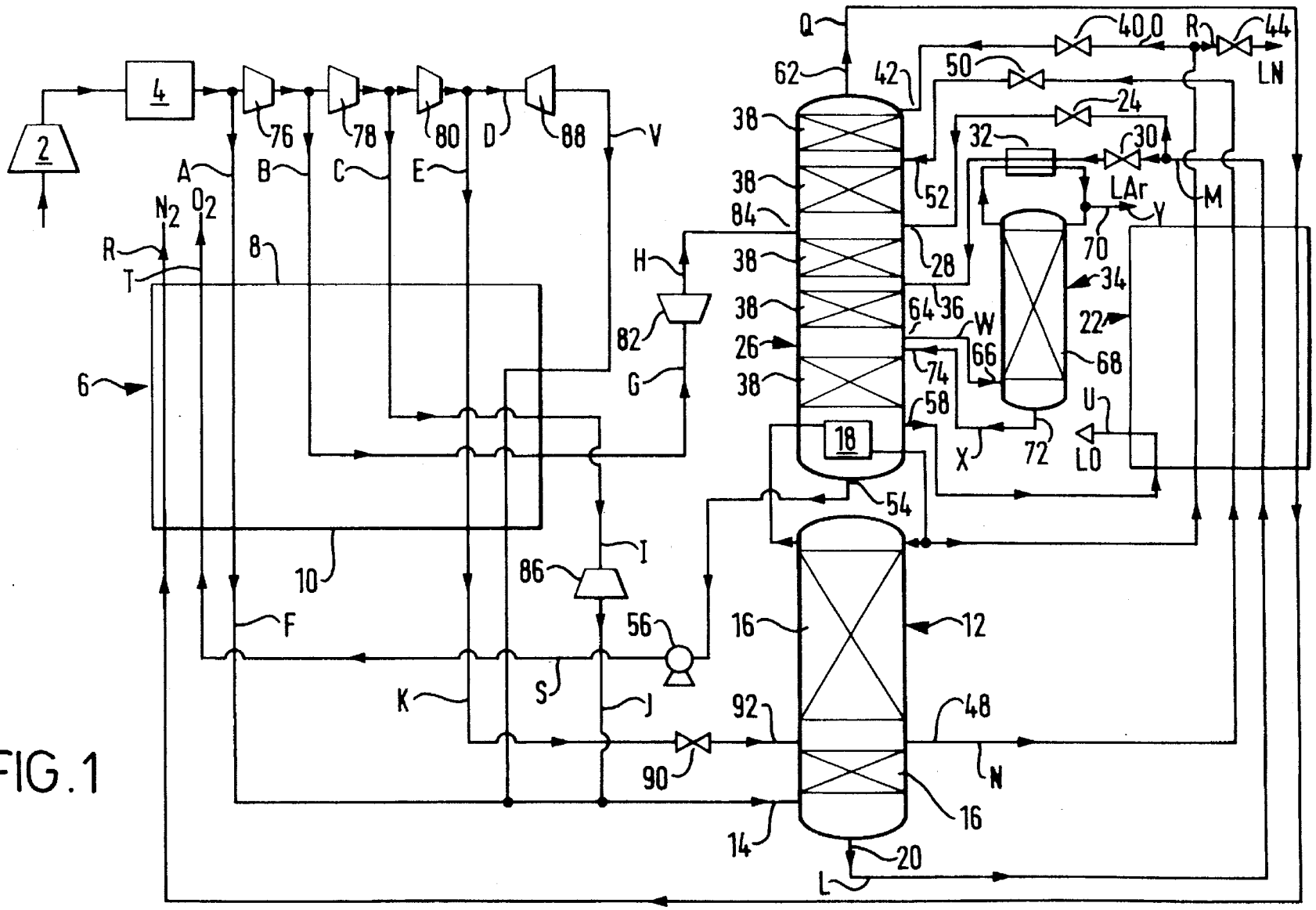
FIG. 1 is a schematic flow diagram illustrating an air separation plant according to the invention.

Referring to FIG. 1 of the drawings, a feed air stream is compressed in a compressor and the resulting compressed feed air stream is passed through a purification unit 4 effective to remove water vapour and carbon dioxide therefrom. The unit 4 employs beds (not shown) of adsorbent to effect this removal of water vapour and carbon dioxide. The beds are operated out of sequence with one another such that while one or more beds are purifying the feed air stream the remainder are being regenerated, for example, by being purged with a stream of hot nitrogen. Such purification units and their operation are well known in the art and need not be described further.

A first air stream is taken from the purified air stream and is passed through a main heat exchanger 6 from its warm end 8 to its cold end 10. The first air stream is thus reduced in temperature from about ambient temperature to a temperature suitable for its separation by rectification. The cooled first air stream is introduced into a higher pressure rectification column 12 through an inlet 14 located below all liquid-vapour mass exchange devices 16 located therein. The liquid-vapour mass exchange devices 16 may take the form of distillation trays or of a packing. In the higher pressure rectification column 12 ascending vapour comes into contact with descending liquid and mass exchange takes place therebetween on the devices 16. The descending liquid is created by withdrawing nitrogen vapour from the top of the higher pressure rectification column 12, condensing the vapour in the condensing passages of a condenser-reboiler 18 and returning a part of the resulting condensate to the top of the column 12 so that it can flow downwardly therethrough. Ascending vapour becomes progressively enriched in nitrogen as it ascends the higher pressure rectification column 12.

Liquid approximately in equilibrium with the air that enters the column 12 through the inlet 14, and hence somewhat enriched in oxygen, collects at the bottom of the higher pressure rectification column 12. A stream of this oxygen-enriched liquid air is withdrawn from the higher pressure rectification column 12 through an outlet 20 and is sub-cooled by passage through a heat exchanger 22. The sub-cooled oxygen-enriched liquid air stream is divided into two subsidiary streams. One subsidiary stream is passed through a throttling valve 24 and is introduced into a lower pressure rectification column 26 through an inlet 28. The other subsidiary stream of sub-cooled oxygen-enriched liquid air is passed in sequence through another throttling valve 30 and a condenser 32 associated with a further rectification column 34 for producing an argon product. The oxygen-enriched liquid passing through the condenser 32 condenses argon taken from the top of the rectification column 34 and is itself at least partly reboiled. The resulting at least partially reboiled oxygen-enriched liquid air stream is introduced into the lower pressure rectification column 26 through an outlet 36 located at a mass exchange level below that of the inlet 28.

The oxygen-enriched air introduced into the lower pressure rectification column 26 through the inlets 28 and 36 is separated therein into oxygen and nitrogen. Liquid-vapour devices 38 are employed in the lower pressure rectification column in order to effect mass exchange between descending liquid and ascending vapour. As a result of this mass exchange the ascending vapour becomes progressively richer in nitrogen and the descending liquid progressively richer in oxygen. The liquid-vapour contact devices 38 may take the form of distillation trays or of packing. In order to provide liquid nitrogen reflux for the lower pressure rectification column 26 a stream of liquid nitrogen condensate is taken from the condenser-reboiler 18 and rather than being returned to the higher pressure rectification column 12 with the rest of the condensate is sub-cooled by passage through the heat exchanger 22. The sub-cooled liquid nitrogen stream is then divided into two subsidiary streams. One of these subsidiary streams is passed through a throttling valve 40 and introduced into the top of the lower pressure rectification column 26 through an inlet 42. The other subsidiary stream of liquid nitrogen is passed through a throttling valve 44 and is collected as product in a thermally-insulated storage tank (not shown).

The collection of the liquid nitrogen product tends to deplete the lower pressure rectification column 26 of reflux. In order to compensate for this depletion of liquid nitrogen reflux, a stream of liquid air is withdrawn from the higher pressure column 12 through an outlet 48, is sub-cooled by passage through the heat exchanger 22, is passed through a throttling valve 50 and is introduced into the lower pressure rectification column 26 through an inlet 52 at an intermediate mass exchange level located above that of the inlet 28.

The condenser-reboiler 18 operates to reboil liquid oxygen at the bottom of the lower pressure rectification column 26 and thus provides an upward flow of vapour through the column 26. A first stream of liquid oxygen product is withdrawn from the bottom of the lower pressure column 26 through an outlet 54 by means of a pump 56 which raises the pressure of the liquid oxygen to a pressure above that of the higher pressure rectification column 12. If desired, the pump 56 may raise the oxygen to a supercritical pressure. The resulting pressurised oxygen stream flows through the heat exchanger 6 from its cold end 10 to its warm end 8 and is thus warmed to approximately ambient temperature. A liquid oxygen product is withdrawn from the bottom of the liquid-vapour mass exchange devices 38 in the lower pressure rectification column 26 through an outlet 58, is sub-cooled by passage a part of the way through the heat exchanger 22, is withdrawn therefrom at an intermediate region, and is passed into a thermally-insulated storage tank (not shown).

A gaseous nitrogen product is withdrawn from the top of the lower pressure rectification column 26 through an outlet 62, is warmed in the heat exchanger 22 by countercurrent heat exchange with the streams being sub-cooled, and is further warmed to approximately ambient temperature by passage through the main heat exchanger 6 from its cold end 10 to its warm end 8. If there is no use for the nitrogen product it may be vented back to the atmosphere.

In order to produce an argon product, a stream of argon-enriched liquid oxygen is withdrawn from the lower pressure rectification column 26 through an outlet 64 situated below the inlet 36 and is introduced into the bottom of the further rectification column 34 through an inlet 66. Liquid-vapour mass exchange devices 68 are located in the rectification column 34 and enable mass transfer to take place between an ascending vapour phase and a descending liquid phase formed by returning to the top of the column 34 some of the condensate from the condenser 32. The devices 68 may take the form of distillation trays or a packing. One advantage of using a low pressure drop structured packing as the contact devices 68 is that it enables a sufficient height of packing to be provided in the column 34 for oxygen-free argon to be produced at the top of the column 34 without either sacrificing argon yield or producing such a pressure drop that there is an inadequate temperature difference between the condensing argon and the boiling oxygen-enriched liquid air in the condenser 32. The remaining condensate from the condenser 30 flows into a conduit 70 communicating with a vessel (not shown) in which the remaining condensate is collected as liquid product.

A stream of liquid is withdrawn from the bottom of the rectification column 34 through an outlet 72 and is returned to an intermediate mass exchange region of the lower pressure rectification column 26 through an inlet 74. If oxygen-free argon is produced, the column 68 will typically be substantially taller than the column 26 with the result that a pump (not shown) may be needed to return the liquid from the bottom of the further rectification column 34 to the lower pressure rectification column 26.

In order to provide refrigeration for the production of liquid product, some of that part of the compressed, purified feed air which does not go to form the first air stream is further compressed in a sequence of three further compressors 76, 78 and 80 each of which is used to provide a feed to a separate expansion turbine. A second compressed air stream is formed from the further air stream leaving the compressor 76. The second compressed air stream is cooled by passage through the main heat exchanger 6 to a temperature in the order of 150 K, is withdrawn at this temperature from an intermediate region of the main heat exchanger 6 and is expanded with the performance of external work in a first expansion turbine 82 to approximately the operating pressure of the lower pressure rectification column 26. The resultant expanded second air stream is introduced into the lower pressure rectification column 26 through an inlet 84 at the same mass exchange level as the inlet 28.

That part of the further compressed air that is not taken to form the second air stream flows through the compressor 78 and is compressed to an even higher pressure. A part of the resulting compressed air is taken to form a third air stream which is cooled to a temperature of approximately 150 K by passage through the main heat exchanger 6. The third air stream is withdrawn from the main heat exchanger 6 at the temperature of approximately 150 K and is expanded with the performance of external work in a second expansion turbine 86. The resulting expanded third air stream leaves the turbine 86 at approximately the pressure of the higher pressure rectification column 12 and is introduced into the bottom thereof, typically being pre-mixed with the first air stream intermediate the cold end 10 of the main heat exchanger 6 and the inlet 14.

That part of the air leaving the compressor 78 which does not go to from the third air stream is further compressed in the compressor 80. A fourth air stream is formed from the air leaving the outlet of the compressor 80 and is expanded with the performance of external work in a third expansion turbine 88. The resulting expanded fourth air stream leaves the third turbine 88 at a temperature of about 150 K and is introduced into the main heat exchanger 6 at an intermediate heat exchange region thereof. The expanded fourth air stream flows through the main heat exchanger 6 in the direction of its cold end 10 and downstream of the heat exchanger 6 is introduced into the bottom of the higher pressure rectification column 12, preferably being merged upstream of the inlet 14 with the first air stream.

The remaining air which is not taken from the outlet of the compressor 84 for expansion in the third expansion turbine 88 is taken as a fifth air stream and passes through the main heat exchanger 6 from its warm end 8 to its cold end 10. Typically, the fifth air stream flows through the heat exchanger 6 at a supercritical pressure. The temperature-enthalpy profile of the fifth air stream has a portion where its rate of change of temperature per unit change of enthalpy is much less than in other portions. Since the pressurised liquid oxygen stream passing countercurrently to it through the main heat exchanger 6 has a similarly shaped temperature-enthalpy profile, the provision of the fifth air stream may be used to maintain relatively efficient heat exchange conditions in the heat exchanger 6.

Downstream of the cold end 10 of the main heat exchanger 6, the fifth air stream is passed through a throttling valve 90 and is introduced into the higher pressure rectification column 12 through an inlet 92 at the same intermediate mass exchange level as the outlet 48. If the fifth air stream enters the throttling valve 90 in the supercritical state, it will emerge from the outlet of the throttling valve 90 predominately in liquid state. Otherwise, the fifth air stream will enter and leave the throttling valve 90 as a liquid. Introduction of liquid air into the higher pressure rectification column 12 through the inlet 92 helps to enhance the rate at which liquid air can be withdrawn through the outlet 48 and passed into the lower pressure rectification column 26.

In a typical example of the operation of the plant shown in FIG. 1, the higher pressure rectification column 12 has an operating pressure a little below 6 bar at its bottom, and the lower pressure rectification column 26 has an operating pressure in the order of 1.5 bar at its bottom; the first expansion turbine 82 has an inlet pressure of about 18 bar, the second expansion turbine 86 an inlet pressure of about 25 bar, and the third expansion turbine 88 an inlet pressure of about 80 bar. The inlet pressure of the third expansion turbine 88 may be reduced by pre-cooling the fourth air stream to below ambient temperature (say to a temperature in the range 220 to 260 K) in the main heat exchanger 6. If this is done, the outlet pressure of the compressor 80 is set at a lower value and thus the fifth air stream is produced at a lower pressure.

The compressors and turbines used in the plant in FIG. 1 of the drawings typically have adjustable or variable guide vanes enabling flow through different parts of the plant to be varied. For example, the flow through the compressor 78 can be decreased with the result that the rate of producing air at about 18 bar for expansion in the turbine 82 is increased. To cater for this different air flow regime, the guide vanes on the turbines 82 and 86 are adjusted so that the turbine 82 is able to expand air at a higher rate and the turbine 86 is able to expand air at a corresponding lower rate. The overall power consumption of the plant is reduced but at the cost of reduced argon production.

The results of a computer-simulated example of the operation of the plant shown in FIG. 1 are given in Table 1 below.

TABLE 1

| Stream | Flow Rate $sm^3\ hr^{-1}$ | Pressure Bar | Temperature K. | State | Mole Fraction $O_2$ | Ar | $N_2$ |
|---|---|---|---|---|---|---|---|
| A | 72000 | 5.9 | 293.0 | V | 0.21 | 0.01 | 0.78 |
| B | 17500 | 15.2 | 293.0 | V | 0.21 | 0.01 | 0.78 |
| C | 21000 | 27.5 | 293.0 | V | 0.21 | 0.01 | 0.78 |
| D | 11000 | 80.0 | 292.9 | V | 0.21 | 0.01 | 0.78 |
| E | 46050 | 80.0 | 293.0 | V | 0.21 | 0.01 | 0.78 |
| F | 72000 | 5.8 | 100.3 | V | 0.21 | 0.01 | 0.78 |
| G | 17500 | 15.0 | 153.0 | V | 0.21 | 0.01 | 0.78 |
| H | 17500 | 1.45 | 85.2 | V | 0.21 | 0.01 | 0.78 |
| I | 21000 | 27.3 | 153.0 | V | 0.21 | 0.01 | 0.78 |
| J | 21000 | 5.8 | 100.6 | V | 0.21 | 0.01 | 0.78 |
| K | 46050 | 79.9 | 100.3 | L* | 0.21 | 0.01 | 0.78 |
| L | 58412 | 5.8 | 100.1 | L | 0.39 | 0.01 | 0.60 |
| M | 58413 | 5.7 | 97.0 | L | 0.39 | 0.01 | 0.60 |
| N | 41000 | 5.8 | 98.1 | L | 0.22 | 0.01 | 0.77 |
| O | 44019 | 5.6 | 82.0 | L | — | — | 1.00 |
| P | 910 | 5.6 | 82.0 | L | — | — | 1.00 |
| Q | 125148 | 1.4 | 80.5 | V | 0.01 | — | 0.99 |
| R | 125148 | 1.0 | 290.4 | V | 0.01 | — | 0.99 |
| S | 29411 | 41.0 | 95.5 | L | 1.00 | — | 0.99 |
| T | 29411 | 40.9 | 290.5 | V | 1.00 | — | — |
| U | 5091 | 1.0 | 88.0 | L | 1.00 | — | — |
| V | 11000 | 5.8 | 169.4 | V | 0.21 | 0.01 | 0.78 |
| W | 45000 | 1.3 | 93.1 | V | 0.92 | 0.08 | — |
| X | 43717 | 1.3 | 92.3 | L | 0.94 | 0.06 | — |
| Y | 1283 | 1.0 | 85.5 | L | — | 1.00 | — |

Figure 2:
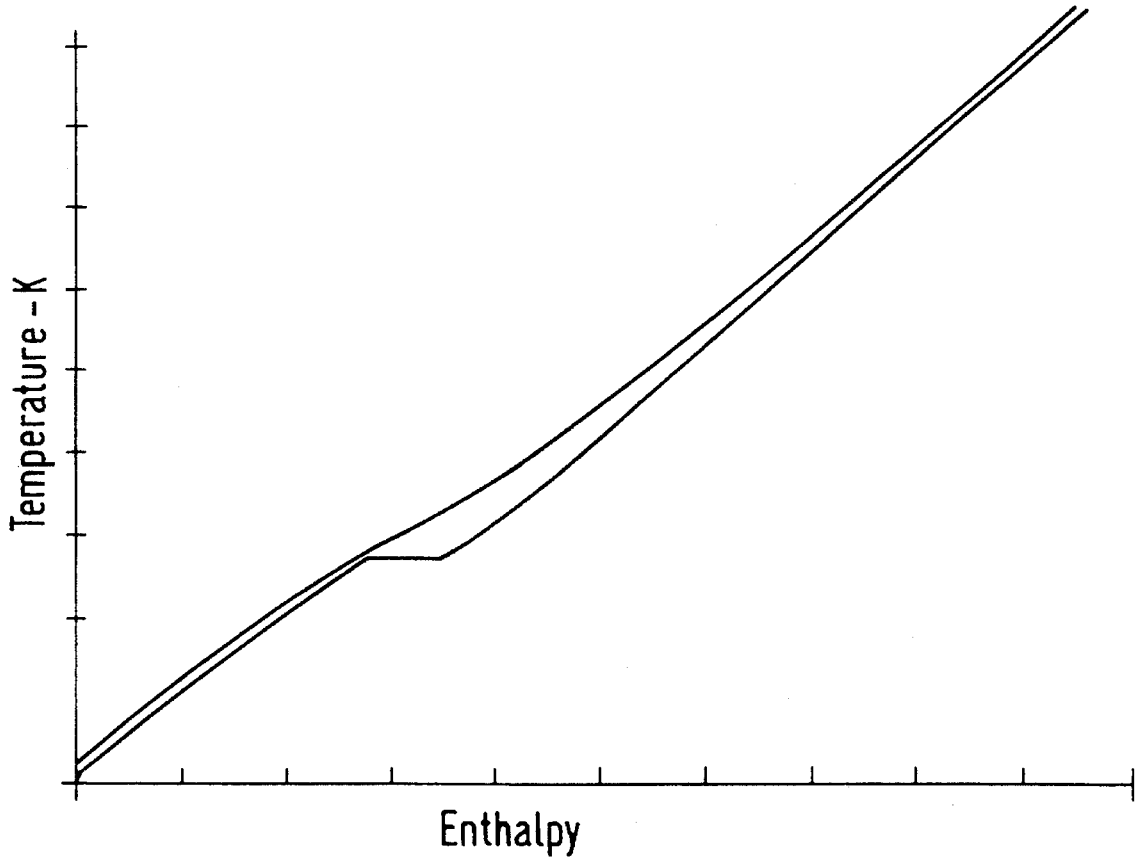
FIG. 2 is a graph illustrating the temperature-enthalpy profiles of the streams being warmed and cooled in one example of the operation of the main heat exchanger forming part of the plant shown in FIG. 1.

V = vapour
L = liquid
L* = supercritical fluid which on expansion yields a liquid FIG. 2 illustrates the temperature-enthalpy profiles of the streams being warmed and the streams being cooled in the main heat exchanger 6 shown in FIG. 1 when the plant is operated in accordance with the example set out in the Table.

I claim:

1. A method of separating air, comprising:

cooling a first compressed air stream to a temperature suitable for its separation by rectification;

separating nitrogen from the cooled first air stream in a higher pressure rectification column;

employing directly or indirectly a stream of oxygen-enriched liquid air withdrawn from the higher pressure column as a feed stream to a lower pressure rectification column;

withdrawing a liquid stream from an intermediate mass exchange region of the higher pressure rectification column and introducing the liquid stream into the lower pressure rectification column as a further feed stream;

separating the said feed streams into nitrogen and oxygen in the lower pressure rectification column;

withdrawing oxygen and nitrogen products from the lower pressure rectification column and employing them to cool incoming air for separation by indirect heat exchange therewith;

collecting a liquid nitrogen product from the lower pressure rectification column;

separating an argon product in a further rectification column from an argon-enriched oxygen stream withdrawn from the lower pressure rectification column;

cooling a second compressed air stream, expanding the cooled second air stream in a first expansion turbine and introducing the resulting expanded second air stream into the lower pressure rectification column:

cooling a third compressed air stream and expanding the cooled third air stream in a second expansion turbine;

introducing the resulting expanded third air stream into the higher pressure rectification column;

expanding a compressed fourth air stream in a third expansion turbine which has an outlet temperature above that of each the first and second turbines;

further cooling the resulting expanded fourth air stream; and introducing the further cooled fourth air stream into one of either and both of the higher pressure and lower pressure rectification columns.

2. The method as claimed in claim 1, in which at least some of the oxygen product is withdrawn in liquid state as a stream from the lower pressure rectification column and is vaporised by countercurrent heat exchange with a fifth compressed air stream and the heat exchanged fifth air stream is reduced in pressure by passage through a throttling valve and is introduced in liquid state into the higher pressure rectification column, and the vaporised oxygen product stream is produced at above the operating pressure of the higher pressure rectification column.

3. The method as claimed in claim 2, in which the fifth air stream is introduced into the heat exchange relationship with the oxygen product stream at the same pressure as the fourth air stream is introduced into the third turbine.

4. The method as claimed in claim 1, in which the first turbine has an inlet pressure lower than the second turbine which is turn has an inlet pressure lower than the third turbine.

5. The method as claimed in claim 1, in which a part of the oxygen product is collected in liquid state.

6. The method as claimed in claim 1, in which all of the further cooled fourth air stream is introduced into the higher pressure rectification column.

7. An apparatus for separating air comprising:

a main heat exchanger for cooling a first compressed air stream to a temperature suitable for its separation by rectification;

a higher pressure rectification column for separating nitrogen from the cooled first air stream;

a lower pressure rectification column for separating into nitrogen and oxygen a feed stream formed directly or indirectly from oxygen-enriched liquid air withdrawn in use from the higher pressure column;

means for the withdrawal of a liquid stream from an intermediate mass exchange region of the higher pressure column, said withdrawal means communicating with the lower pressure rectification column;

means for withdrawing oxygen and nitrogen products from the lower pressure rectification column and for returning them through the main heat exchanger countercurrently to the incoming air;

means for collecting a liquid nitrogen product from the lower pressure rectification column;

a further rectification column for separating an argon product from an argon-enriched oxygen stream withdrawn in operation from the lower pressure rectification column;

a first expansion turbine for expanding a cooled, second compressed air stream having an outlet communicating with the lower pressure rectification column;

a second expansion turbine for expanding a cooled, third compressed air stream having an outlet communicating with the higher pressure rectification column; and a third expansion turbine for expanding a fourth air stream having an outlet communicating via air cooling means with one or both of the higher pressure and lower pressure rectification columns.

8. The apparatus as claimed in claim 7, in which the means for withdrawing the oxygen product comprise a pump having an inlet communicating with the lower pressure rectification column and an outlet communicating with said main heat exchanger.

9. The apparatus as claimed in claim 7, additionally including a vessel for collecting liquid oxygen product.

* * * * *